US005786573A

United States Patent [19]

Fabrikant et al.

[11] Patent Number: 5,786,573

[45] Date of Patent: Jul. 28, 1998

[54] HEATER FOR SHAVING CREAM CONTAINERS ENABLING VERTICAL ADJUSTMENT OF THE HEATER RELATIVE TO THE CONTAINER

[76] Inventors: Marvin Fabrikant; Patricia Fabrikant, both of 5149 Tilden St. NW., Washington, D.C. 20016

[21] Appl. No.: 739,671

[22] Filed: Oct. 31, 1996

Related U.S. Application Data

[63] Continuation of Ser. No. 604,699, Feb. 21, 1996, abandoned, which is a continuation-in-part of Ser. No. 576,379, Dec. 21, 1995, abandoned, which is a continuation-in-part of Ser. No. 499,575, Jul. 7, 1995, abandoned.

[51] Int. Cl.[6] ..... H05B 1/00

[52] U.S. Cl. ..... 219/535; 219/438; 219/432; 222/146.5

[58] Field of Search ..... 219/200, 201, 219/214, 242, 385–387, 432, 433, 438, 446, 441, 535, 520, 521; 392/473, 474, 476, 477, 459, 444; 222/146.5, 146.3, 192; 141/82; 248/311.2, 311.3, 346.03, 346.11

[56] References Cited

U.S. PATENT DOCUMENTS

| | | | |
|---|---|---|---|
| 1,244,817 | 10/1917 | Willson | 392/459 |
| 1,650,999 | 11/1927 | Preston | 219/432 |
| 1,657,479 | 1/1928 | MacFarland | 338/208 |
| 1,717,132 | 6/1929 | Weinmann | 219/433 |
| 1,827,649 | 10/1931 | Gallipoli et al. | 222/130 |
| 2,079,611 | 5/1937 | Harvey | 219/521 |
| 2,277,605 | 3/1942 | Palitzsch | 219/521 |
| 2,292,992 | 8/1942 | Crouch | 219/521 |
| 2,445,930 | 7/1948 | Arens | 219/535 |
| 2,451,124 | 10/1948 | Smith | 219/201 |
| 2,500,241 | 3/1950 | Brown | 219/438 |
| 2,516,637 | 7/1950 | McCollum | 219/433 |
| 2,518,538 | 8/1950 | Giblin | 248/311.2 |
| 2,700,097 | 1/1955 | Morey | 219/433 |
| 3,231,716 | 1/1966 | Van Den Bosch | 219/433 |
| 3,338,476 | 8/1967 | Marcoux | 222/146.3 |
| 3,432,641 | 3/1969 | Welke | 219/433 |
| 3,454,745 | 7/1969 | Stone | 219/415 |
| 3,527,922 | 9/1970 | Reich et al. | 392/477 |
| 3,790,033 | 2/1974 | Ciaffone | 392/476 |
| 3,896,973 | 7/1975 | Morgan . | |
| 3,904,086 | 9/1975 | Losenno . | |
| 4,421,973 | 12/1983 | Lou | 392/477 |
| 4,442,343 | 4/1984 | Genuit et al. | 219/433 |
| 4,716,278 | 12/1987 | Cappe et al. | 219/521 |
| 4,959,528 | 9/1990 | Malloy | 219/432 |
| 5,072,095 | 12/1991 | Hoffmann | 219/432 |
| 5,591,367 | 1/1997 | Schwarzkopf | 219/535 |

FOREIGN PATENT DOCUMENTS

| | | | |
|---|---|---|---|
| 811246 | 8/1951 | Germany | 219/535 |
| 2340965 | 2/1975 | Germany | 219/535 |
| 112293 | 10/1944 | Sweden | 219/535 |

*Primary Examiner*—John A. Jeffery
*Attorney, Agent, or Firm*—Foley & Lardner

[57] ABSTRACT

A heater for conventional shaving cream containers is described which includes a dome- or ring-shaped heating element. The ring-shaped heating element can be either a donut-shaped heater that fits around the outer surface at the upper region of the shaving cream container, or it can be a dome or inverted dome-shaped heating element permitting the weight of the container to rest on the heating element. Also, the ring-shaped heater may include an inner ring which allows the heater to hang from an upper edge of the shaving cream container or it may be made without an inner ring so that it can be slidably adjusted up and down the length of the shaving cream container.

11 Claims, 7 Drawing Sheets

5
6
12
(THERMOSTAT)
11
(BATTERY)
3

1
2
2
4
5
2
3
6

HEATER FOR SHAVING CREAM CONTAINERS ENABLING VERTICAL ADJUSTMENT OF THE HEATER RELATIVE TO THE CONTAINER

This application is a continuation of application Ser. No. 08/604,699, filed Feb. 21, 1996 now abandoned, which is a continuation-in-part of U.S. Ser. No. 08/576,379, filed on Dec. 21, 1995 now abandoned, which in turn, is a continuation-in-part of U.S. Ser. No. 08/499,575, filed on Jul. 7, 1995 abandoned.

BACKGROUND OF THE INVENTION

U.S. Pat. No. 3,454,745 to Stone discloses a heater for shaving lather containers comprising an open-ended cylinder consisting of a housing and liner into which the shaving lather container is placed, the bottom of which has a raised, cube-shaped heating element that imparts heat to the bottom of the shaving lather container by heating the liner.

U.S. Pat. No. 1,827,649 to Gallipoli discloses a device for producing and dispensing lather which integrates a heating element and lather dispenser in one device.

U.S. Pat. No. 3,896,973 to Morgan discloses a device for heating liquid containers, comprising a base with one or more cone-shaped heating elements adapted to fit the bottom of the liquid containers which are placed on top of the heating elements.

SUMMARY OF THE INVENTION

The various devices of the prior art suffer from disadvantages such as lack of mobility, bulkiness, failure to heat shaving cream at the top of the shaving cream container or failure to heat shaving cream at the precise location where it is drawn into a dispensing tube at the bottom of a shaving cream container in the case of those shaving cream containers which use dispensing tubes, and inefficient and indirect heating of a shaving cream container resulting in wasted energy. The present inventor undertook to solve these and other problems, resulting in the discovery of an improved device for heating conventional shaving cream containers.

DETAILED DESCRIPTION OF THE PREFERRED EMBODIMENTS

Figures 1, 2:
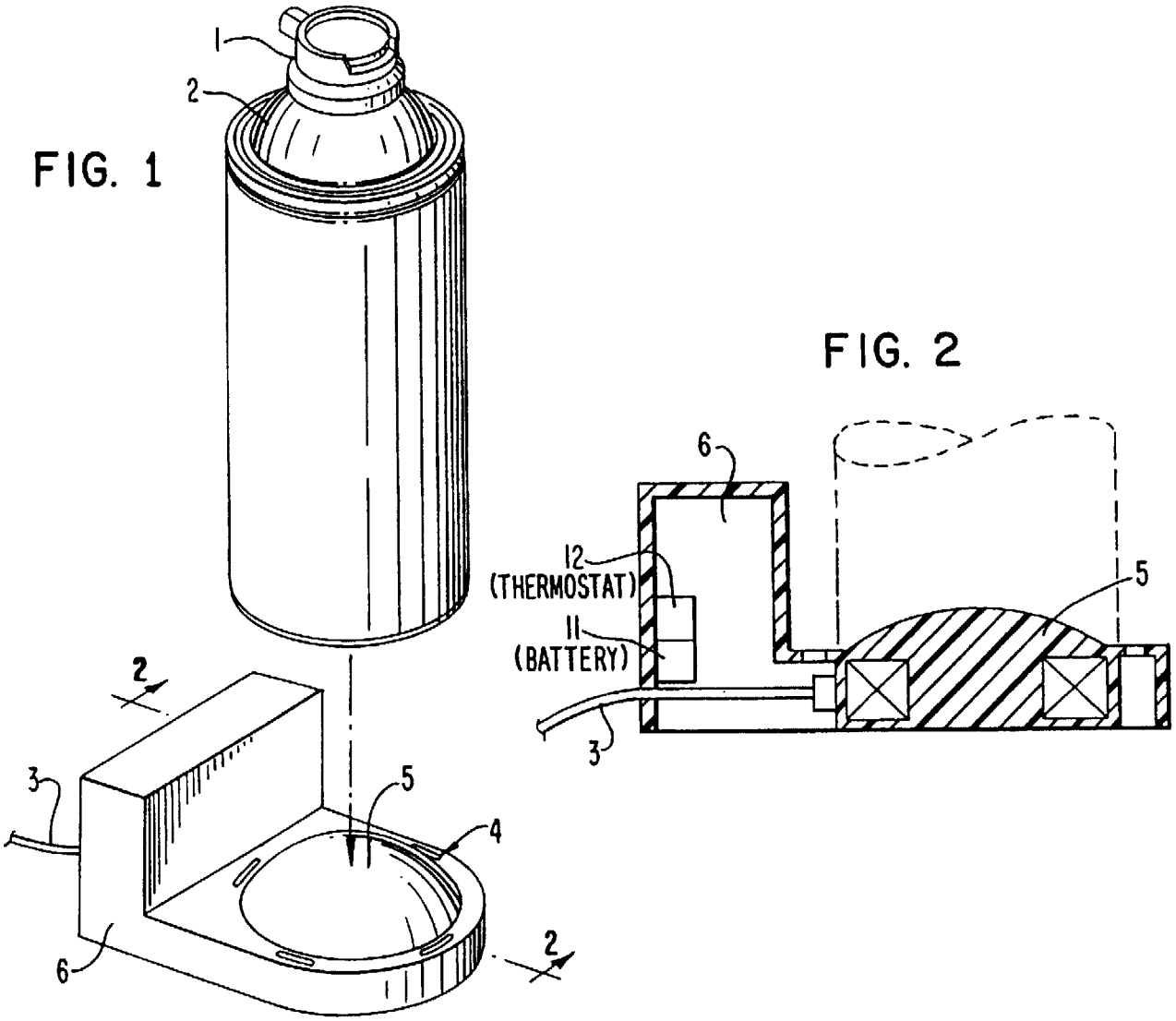
FIG. 1 is a side view of one embodiment of the present invention having a base with a dome-shaped heating element which fits into the bottom of a shaving cream container shown above the dome-shaped heating element.
FIG. 2 is a cross-sectional view of the embodiment of FIG. 1 wherein the shaving cream container is fitted in position to contact the heating element.

In one embodiment, the present invention is directed to a heater for a shaving cream container comprising a base and a dome-shaped heating element mounted in the base, said dome-shaped heating element being shaped to fit into a bottom of a shaving cream container.

In another embodiment, the present invention is directed to a heater for a shaving cream container comprising a base and an inverted dome-shaped heating element mounted in the base, said inverted dome-shaped heating element being shaped to receive a top portion of a shaving cream container.

In another embodiment, the present invention is directed to a heater for a shaving cream container comprising a ring-shaped heating unit with an inner curved heating surface shaped to fit an upper curved section of a shaving cream container and an outer surface insulated from the inner curved heating surface. This embodiment can either be placed around the top of a shaving cream container standing right side up or the heating unit can be turned upside down so that the shaving cream container stands on its head when fitted into the ring-shaped heating unit. Optionally, the ring-shaped heating unit may have a cut-away section for easier placement over the plastic dispensing head of the container. Preferably, the inner surface is made of a metal.

In still another embodiment, the present invention is directed to a heating device for a shaving cream container comprising a ring-shaped heater adapted to fit around a shaving cream container and capable of being adjusted up and down the length of the shaving cream container. In this embodiment, the heater comprises a ring-shaped heating element which fits around a shaving cream container and is capable of being pushed down around a bottom of the shaving cream container so that shaving cream is heated through a side wall at the bottom of the shaving cream container where it is taken up by a dispensing tube in the case of containers which use a dispensing tube. The ring-shaped heater fits around the circumference of the container tightly enough to stay in position but loosely enough so that one may move the heater up or down the length of the can. The exact size of the ring-shaped heater depends upon the circumference of the shaving cream container.

Optionally, the heater may have an inner rim which rests on a top edge of the shaving cream container to support the heater in a position around the shaving cream container.

Since the ring-shaped heater is handled by its outer surface and can lose heat to the atmosphere, it is preferable to minimize the heat passing through the outer surface with one or more insulating layers on the outer surface. The outer surface of the ring-shaped housing can be made of the same material as the inner surface, or a different material such as an insulating material. Preferably, the entire ring-shaped housing is made of a metal and the outer surface of the ring-shaped housing is coated with an insulating material, such as ceramics, porcelain or a heat-resistant plastic so as to minimize heating of the outer surface during operation.

The heating elements of the present invention can have a self-contained power supply (such as batteries) or be connected by electrically conductive wire to an external power source (such as a standard wall outlet). A preferred source of electricity is an electrical supply cord having one end adapted to fit a standard electrical wall socket in a house and having a second end connected to the heating element. Another preferred source of electricity is a battery which can be either contained inside the ring-shaped heating unit or base, or which can be mounted on the outside.

The heating element of the present invention can be any conventional heating element including electrical resistance heating elements such as a coiled electrically resistant wire.

Preferably, the heaters of the present invention include means for sensing a shaving cream container which activates the heating element when in contact with the shaving cream container and which turns off the heating element when the heater is not in contact with the shaving cream container. For example, the means for sensing a shaving cream container can be two or more ends of a circuit reaching from the electricity source to the surface of the heating element which contacts the shaving cream container. When the container is present, the circuit is completed and electricity flows through the container to complete the circuit and supply electricity to the means for converting electricity into heat.

Preferably, the heating elements of the present invention also comprise a built-in thermostat for regulating the temperature of the shaving cream container to prevent the shaving cream from exceeding a temperature that would cause the contents of the shaving cream container to rupture the container. The thermostat shuts off the heating element or interrupts the electrical supply to the heating element when the shaving cream container reaches a temperature below the temperature at which the shaving cream container is caused to rupture. Preferably, the thermostat shuts off the heating element when the shaving cream container in contact with the heating element reaches a temperature of about 120° F. Alternatively, the thermostat can be adjusted by a user to set the temperature at a desired level.

Another embodiment of the present invention is a method of using the heaters of the above embodiments to heat a conventional shaving cream container. The method comprises placing the shaving cream container inside the heater or on top of the dome-shaped heater, either right side up or upside down in the case of the embodiment having a base with a cavity for receiving the dispensing head of the container, causing the heater to heat the shaving cream container, and dispensing the heated shaving cream from the container.

FIG. 1 is a side view of one embodiment of the present invention having a base 6 with a dome-shaped heating element 5 which fits into the bottom of a conventional shaving cream container shown above the dome-shaped heating element 5. The heater includes a power supply cord 3 which connects to the back of the base 6 and connects internally to the heating element 5. The heater optionally includes sensors 4 that sense the presence of the shaving cream container when in contact with the base of the container, completing a circuit with the heating element 5. When the shaving cream container is not present, the circuit is not completed and the supply of electricity to the heating element 5 is shut off. FIG. 1 also shows the shape and features of a conventional shaving cream container, including the plastic dispensing head 1 and the upper curved section 2.

FIG. 2 is a cross-sectional view of the embodiment of FIG. 1 wherein the shaving cream container is fitted in position so that the container contacts the heating element 5 uniformly about the inverted dome-shaped bottom of the container.

Figure 3:
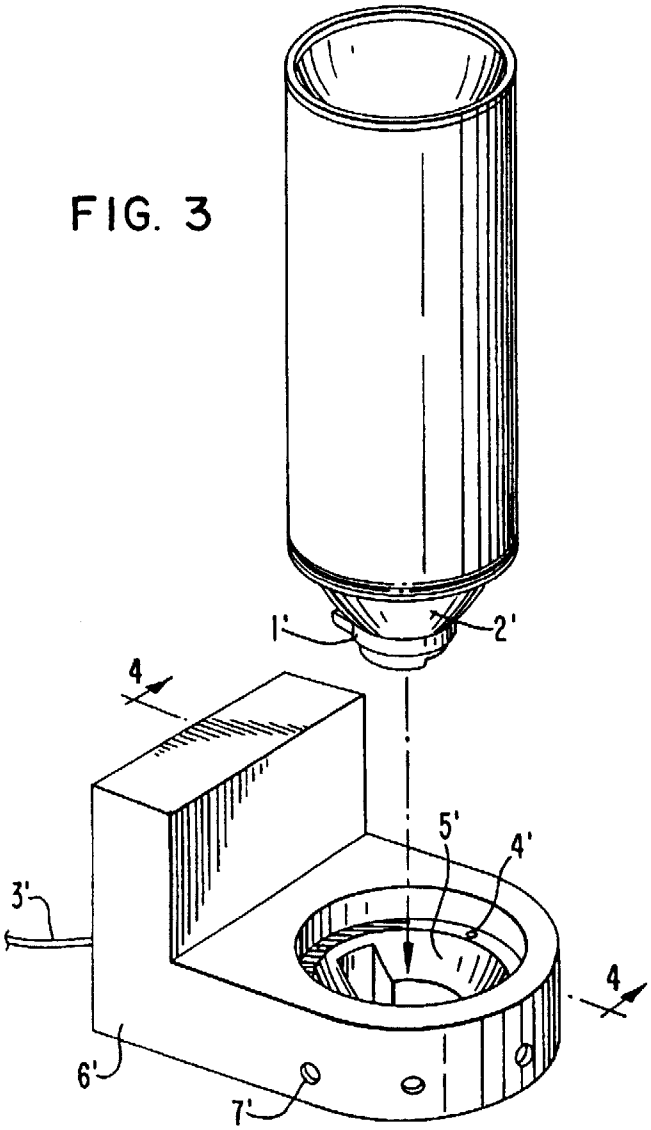
FIG. 3 is a side view of another embodiment of the present invention wherein the base has an inverted dome-shaped heating element that receives the top of a shaving cream container shown above the heating element.

FIG. 3 is a side view of another embodiment of the present invention wherein the base 6' has an inverted dome-shaped heating element 5' that houses and comes into contact with the curved upper metal section 2' of the shaving cream container immediately below the plastic dispensing head 1', the latter of which is not in contact with any heat-producing surface of the heater. The remainder of the shaving cream container stands above the heater as shown in the Figure. The base 6' of the heater optionally includes ventilation holes 7' to prevent heat build-up. A power supply cord 3' connects to the back of the base 6' and supplies electricity to the heating element 5'. Optionally, one or more sensors 4' positioned along a rim above the heating element 5' sense the presence of the container in the same manner described above.

Figure 4:
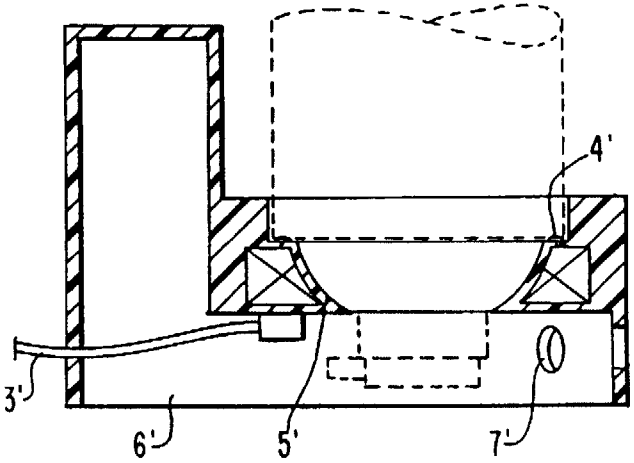
FIG. 4 is a cross-sectional view of the embodiment of FIG. 3 wherein the shaving cream container is fitted in position to contact the heating element.

FIG. 4 is a cross-sectional view of the embodiment of FIG. 3 wherein the shaving cream container is fitted in position to contact the heating element 5' and the plastic dispensing head does not contact any surface of the heater.

Figure 5:
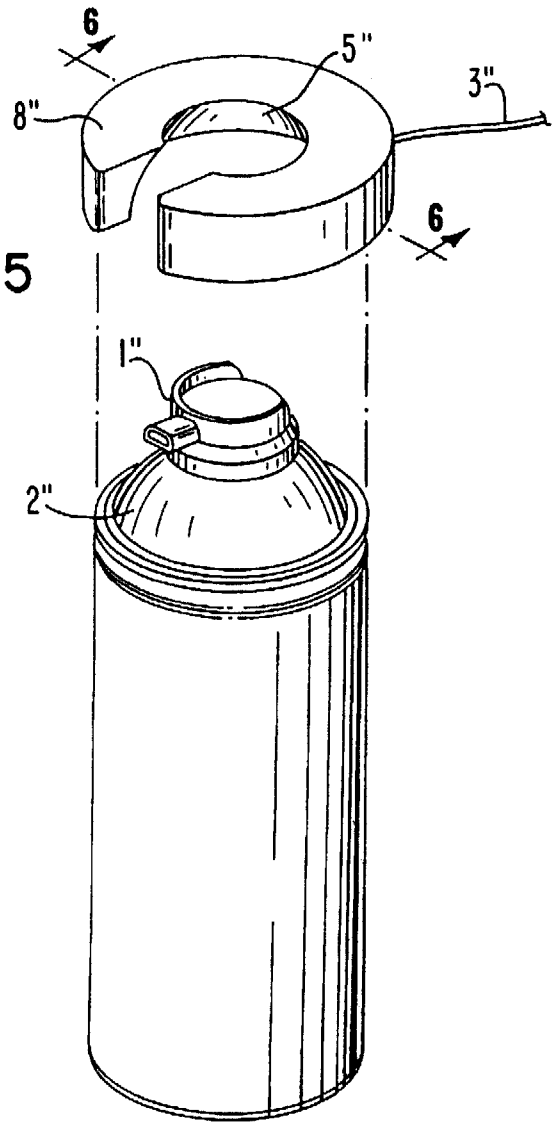
FIG. 5 is a side view of another embodiment of the present invention having a ring-shaped heating element which encloses the curved upper section of a shaving cream container which is shown below the heating element.

FIG. 5 is a side view of another embodiment of the present invention having a ring-shaped heating unit which encloses the curved upper section 2" of a shaving cream container which is shown below the heating unit. The heating unit includes a curved inner heating surface 5" which contacts the curved upper section 2" of the shaving cream container and a power supply cord 3" which connects to the heating unit through the outer surface 8". The outer surface 8" is heat resistant and preferably insulated from the inner curved heating surface 5" for ease of handling. The shaving cream container has a plastic dispensing head 1".

Figure 6:
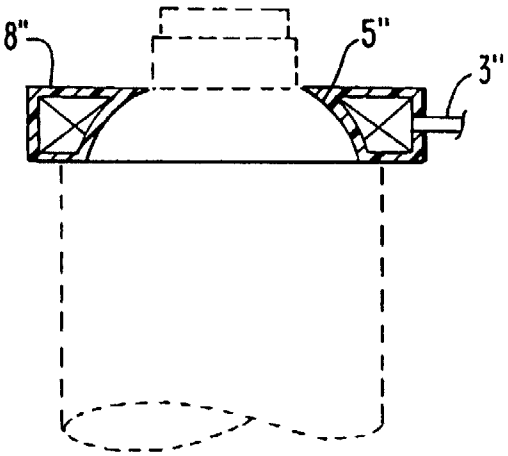
FIG. 6 is a cross-sectional view of the embodiment of FIG. 5 wherein the shaving cream container is fitted in position to contact the heating element.

FIG. 6 is a cross-sectional view of the embodiment of FIG. 5 wherein the shaving cream container is fitted in position to contact the inner curved heating surface 5". A power supply cord 3" connects to the heating unit through the outer surface 8".

Figure 7:
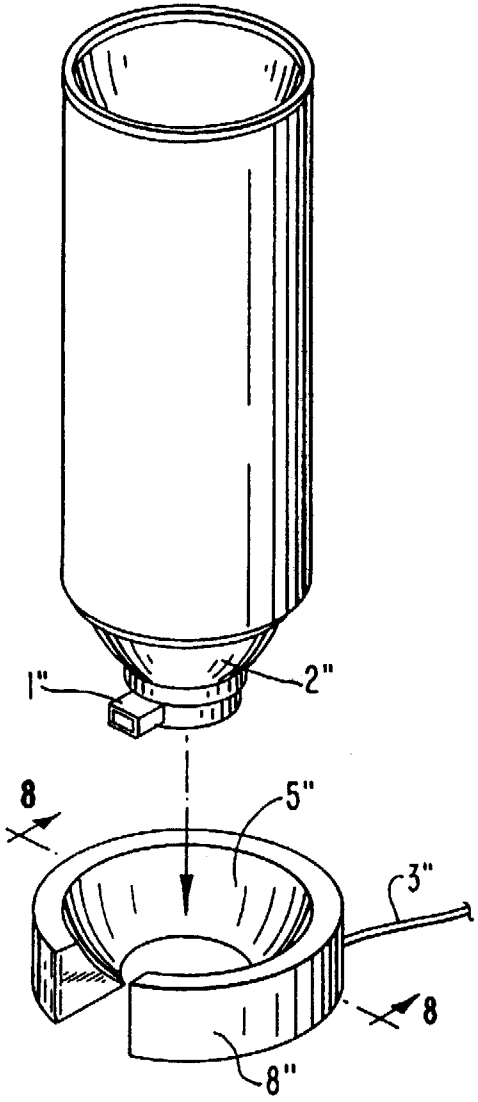
FIG. 7 is the embodiment of FIG. 5 turned upside down with a shaving cream container turned upside down shown above the heating element.

FIG. 7 is the embodiment of FIG. 5 turned upside down with a shaving cream container turned upside down shown above the heating element. The heating unit includes a curved inner heating surface 5" which contacts the curved upper section 2" of the shaving cream container. The outer surface 8" is heat resistant and preferably insulated from the inner curved heating surface 5" for ease of handling. The shaving cream container includes a plastic dispensing head 1". A power supply cord 3" connects to the heating unit through the outer surface 8".

Figure 8:
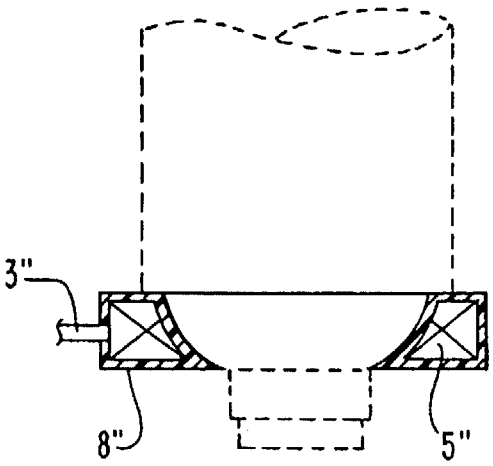
FIG. 8 is a cross-sectional view of the embodiment of FIG. 7 wherein the shaving cream container is fitted in position to contact the heating element.

FIG. 8 is a cross-sectional view of the embodiment of FIG. 7 wherein the shaving cream container is fitted in position to contact the heating element. A power supply cord 3" connects to the heating unit through the outer surface 8". The heating unit includes a curved inner heating surface 5".

Figure 9:
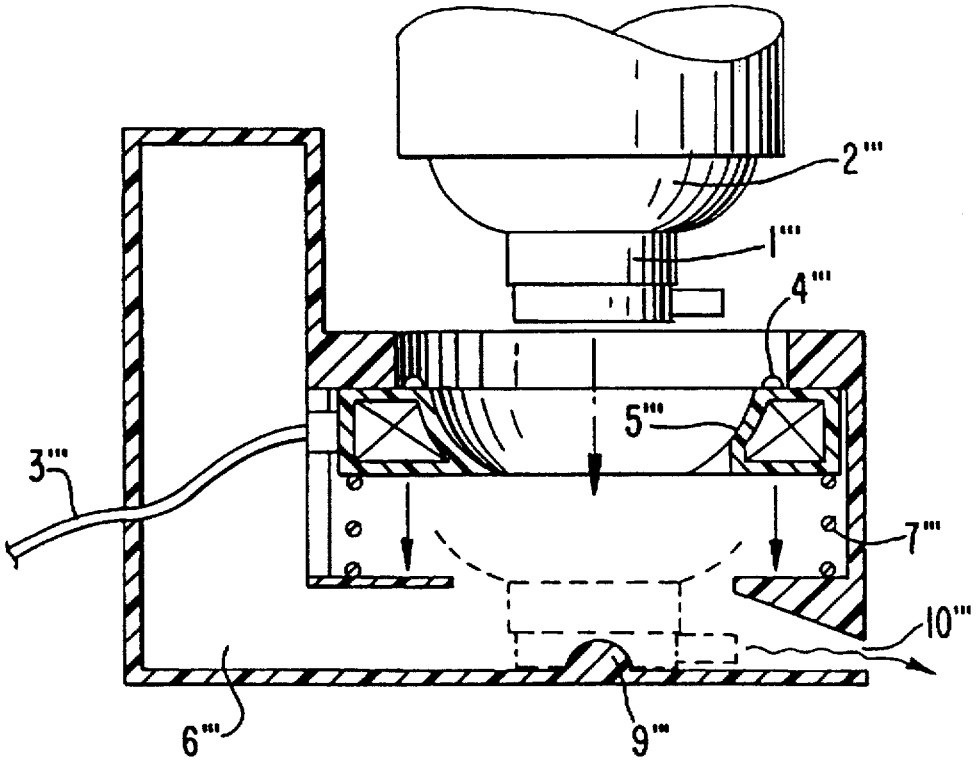
FIG. 9 is another embodiment similar to the embodiment of FIGS. 3 and 4 wherein the inverted dome-shaped heating element is spring-mounted and can be depressed when the shaving cream container shown above the heating element is fitted in position and pushed downward, causing a pin to press the plastic dispensing head and discharge heated shaving cream through a channel in the base.

FIG. 9 is another embodiment similar to the embodiment of FIGS. 3 and 4 wherein the inverted dome-shaped heating element 5" is spring-mounted and can be depressed when the shaving cream container shown above the heating element 5''' is fitted in position and pushed downward, causing a pin 9''' at the bottom of the base 6''' to press the plastic dispensing head 1''' and discharge shaving cream through a channel 10''' in the base. The shaving cream container pictured above the heating unit has a curved upper section 2''' and a plastic dispensing head 1'''. The heater optionally includes a sensor 4''' that senses the presence of the shaving cream container when in contact, completing a circuit with the inverted dome-shaped heating element 5'''. The base 6''' optionally includes ventilation holes 7''' to prevent heat build-up. A power supply cord 3''' connects to the heating unit through a back wall of the base 6'''.

Figure 10:
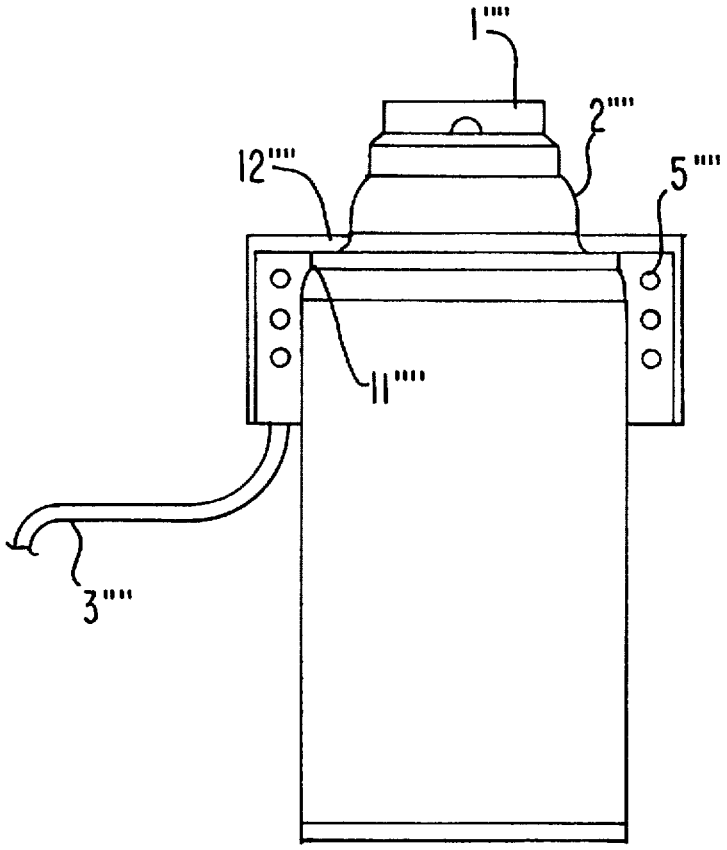
FIG. 10 shows a side view of a shaving cream can with a cut-through side view of a preferred heating device according to the present invention.

FIG. 10 shows another preferred embodiment of a ring-shaped heater of the present invention. The shaving cream container has a head 1'''', curved upper section 2'''', and an upper edge 11''''. The heater comprises a ring-shaped heating element 5'''', a power cord 3'''', and an inner rim 12''''. The inner rim 12'''' rests on top of the upper edge 11'''' of the shaving cream container thereby supporting the ring-shaped heater 5'''' in position around the upper region of the shaving cream container.

Figure 11:
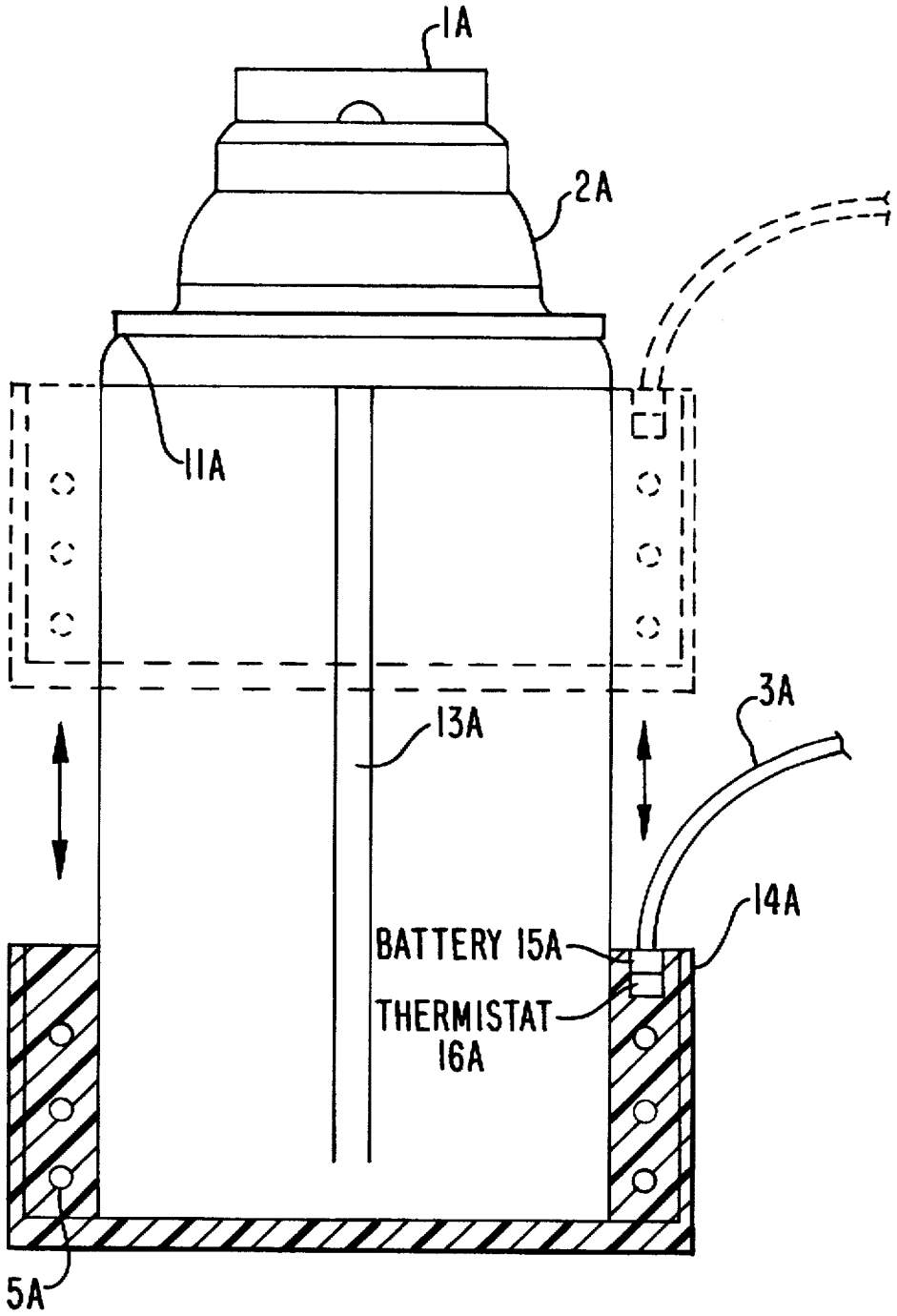
FIG. 11 shows a side view of a shaving cream can a cut-through side view of another preferred heating device of the present invention, which can be adjusted up and down the length of the shaving cream can.

FIG. 11 shows a side view of a shaving cream can and a cut-through side view of another preferred heating device of the present invention, which can be adjusted up and down the length of the shaving cream can. This embodiment is identical to that of FIG. 10 except that there is no inner rim 12'''' in the heater, so that the ring-shaped heater 14A may be pushed up and down the length of the can. The shaving cream container has a head 1A, curved upper section 2A, an upper edge 11A, and a dispensing tube 13A which draws in shaving cream from the bottom of the container. The heater 14A comprises a circular heating element 5A and a power cord 3A. Preferably, the ring-shaped heater 14A is pushed toward the bottom of the can as shown in FIG. 10, where it serves the dual purpose of heating the cream at the point where it is drawn into the dispenser tube 13A (in the case of those shaving cream containers which use a dispensing tube) and stabilizes the container by acting as a base. The ring-shaped heater 14A is easily applied to the container by slipping it over the top of the container and pushing it to the bottom of the container, so that it rests flush with the bottom of the container.

The FIG. 11 embodiment is advantageous because of its ease of construction and simple ring-shaped design, and also because its design permits easy handling of the can, which can be picked up and moved around while the heater 14A is in place around its bottom. Since the heater 14A is localized at the bottom of the container, a user can easily grasp the top of the container, which is not at all obscured by the heater 14A, or the user may grasp the heater 14A itself by its outer wall and pick up the container and heater 14A at the same time. In all cases, the snug fit of the ring-shaped heater 14A around the container permits handling of both the container and the heater 14A without risk of the container slipping through. Optionally, instead of a power supply cord 3A, the heater 14A may utilize a self-contained battery 15A for power. In addition, the heater 14A may optionally contain a thermostat 16A for regulating the temperature of the shaving cream container.

While the invention has been described in detail and with reference to specific embodiments thereof, it will be apparent to one skilled in the art that various changes and modifications can be made therein without departing from the spirit and scope of the invention.

What is claimed is:

1. A method of heating shaving cream in a shaving cream container comprising the steps of:

providing a heater comprising (a) a continuous annular housing having a top surface, a bottom surface, an outer annular surface, and an inner annular surface defining a through-hole extending from said top surface to said bottom surface, and (b) a heating element disposed between said outer and inner annular surfaces of said housing; and disposing said housing around a shaving cream container containing shaving cream to heat the shaving cream therein, said through-hole fitting around said shaving cream container tightly enough to hold the housing in position but loosely enough to permit a user to push the housing up or down.

2. The method as claimed in claim 1, wherein the heating element is embedded within the heat-resistant plastic.

3. The method as claimed in claim 2, wherein the housing is less than half the height of the shaving cream container.

4. The method as claimed in claim 1, wherein the heater further comprises a power supply cord having an end adapted to fit into a 120 V wall socket.

5. The method as claimed in claim 1, wherein the heating element is coiled electrical resistance wire.

6. The method as claimed in claim 1, wherein the heater further comprises at least one battery disposed within said housing.

7. The method as claimed in claim 1, wherein the heater further comprises at least one battery disposed outside said housing.

8. The method as claimed in claim 1, wherein the heater further comprises at least one sensor to turn off the heating element when a shaving cream container is not in contact with the heater and which turns on the heating element when a shaving cream container is in contact with the heater.

9. The method as claimed in claim 1, wherein the heating element is regulated by a thermostat.

10. The method as claimed in claim 1, wherein the thermostat maintains the heating element at a temperature of about 120° F.

11. The method as claimed in claim 1, wherein the shaving cream container is a conventional shaving cream container.

* * * * *